US010441043B2

(12) United States Patent
Bennett

(10) Patent No.: US 10,441,043 B2
(45) Date of Patent: Oct. 15, 2019

(54) CONTACT LENS TRAVEL KIT

(71) Applicant: Ryan Bennett, Houston, TX (US)

(72) Inventor: Ryan Bennett, Houston, TX (US)

( * ) Notice: Subject to any disclaimer, the term of this patent is extended or adjusted under 35 U.S.C. 154(b) by 0 days.

(21) Appl. No.: 15/843,669

(22) Filed: Dec. 15, 2017

(65) Prior Publication Data

US 2018/0103735 A1 Apr. 19, 2018

Related U.S. Application Data

(63) Continuation-in-part of application No. 15/206,030, filed on Jul. 8, 2016.

(60) Provisional application No. 62/191,351, filed on Jul. 11, 2015.

(51) Int. Cl.

| | |
|---|---|
| ***A45C 11/04*** | (2006.01) |
| ***A45C 13/10*** | (2006.01) |
| ***A45C 13/00*** | (2006.01) |
| ***A45C 11/00*** | (2006.01) |

(52) U.S. Cl.

CPC ..... *A45C 11/046* (2013.01); *A45C 11/005* (2013.01); *A45C 13/001* (2013.01); *A45C 13/1076* (2013.01); *A45C 2013/1015* (2013.01)

(58) Field of Classification Search

CPC ..... A45C 11/046; A45C 13/002; B62D 33/30; B65B 11/02

USPC ..... 206/570; 446/376; 40/607.1, 607.3

See application file for complete search history.

(56) References Cited

U.S. PATENT DOCUMENTS

| | | | | |
|---|---|---|---|---|
| 4,951,811 A * | 8/1990 | Lines | A45C 11/046 150/117 |
| 5,373,942 A * | 12/1994 | Weder | A47G 7/085 206/423 |
| 9,534,749 B2 * | 1/2017 | Dai | A44C 5/0053 |
| 2009/0205996 A1 * | 8/2009 | Celis | A44C 5/003 206/570 |

* cited by examiner

*Primary Examiner* — Anthony D Stashick
*Assistant Examiner* — Raven Collins
(74) *Attorney, Agent, or Firm* — Donn K. Harms

(57) ABSTRACT

A contact lens travel device having a flexible body is provided. The body of the device is configurable to a circular configuration wherein fasteners engaged with opposing ends of the body compressively engage the body encircled around an eyeglass case. So engaged, the device is positionable as a stand for a mirror at multiple angles above a support surface for a user to employ for contact lens insertion or removal from their eyes. A fluid container is engageable within a pocket of the body with a cap end of the container extending from the perimeter to allow for dispensing of eye drops therefrom without removal of the container from the pocket.

14 Claims, 7 Drawing Sheets

CONTACT LENS TRAVEL KIT

This application is a Continuation in Part application of U.S. patent application Ser. No. 15/206,030, filed on Jul. 8, 2016, which claims priority to U.S. Provisional Patent Application Ser. No. 62/191,351 filed on Jul. 11, 2015, both of which are incorporated herein by this reference in its entirety.

BACKGROUND OF THE INVENTION

1. Field of the Invention

The present invention relates generally to contact lenses and their transport and use. More particularly, it relates to a system for holding contact lenses, and supplies employed therewith, in a kit configured to form a surrounding biased engagement upon a conventional eyeglass case to allow for easy transition from contact lenses to eyeglasses. Further, the device is configurable to form a stand for a supported mirror to aid in insertion and removal of the contact lenses from the eyes of the user.

2. Prior Art

With the advent of contact lenses for vision correction, use of such lenses which are removably engaged to the eyes of the user has expanded annually. Contact lenses when operatively positioned in the eyes of the user provide exceptional vision correction without the limiting factors involved in using eyeglasses which fail to help peripheral vision and which have frames which can block the vision of the user.

However, users of such contact lenses eventually are required to remove them from their eyes, whereafter they transition to eyeglasses for the duration of that removal. While some contact lenses are disposable and the user inserts new lenses daily, a large portion of the contact lens wearing population uses lenses which are reused. During the time of removal, such lenses conventionally must be soaked for re-hydration as well as for cleaning of the lenses to remove dirt and deposits forming upon them. This duration of containerized soaking in solutions adapted to the task, can take a number of hours. Consequently, most users of contact lenses will simply remove them at a convenient time in the evening, and wear eyeglasses until the following morning.

While contact lens cases exist which are adapted for soaking the contact lenses of a user in a pair of removably sealable containers, such are small in size and are easily misplaced or lost. This is especially true when traveling and instances where the user may wish to remove their contact lenses such as riding on airplanes or sleeping in hotels.

Many users are known to place a contact lens soaking case into the housing of a shaving kit, or inside a purse, or inside a travel bag or the like, anticipating use during the trip. However, as noted above such soaking cases are very small, and easily lost within the large confines of a purse, or shaving kit, or travel bag. Further, even when the soaking case is found, the user must also find their eyeglasses to wear once the lenses are dismounted and positioned within the lens soaking case. Having found their glasses, the lens soaking case is still subject to becoming easily lost in a hotel room, or when placed in a purse or suitcase for the evening.

Additionally, many users of contact lenses now also use disposable contact lenses. While such lenses generally do not require soaking overnight since they are disposed daily, they still require the user to view their eye during insertion.

Further, as with conventional contact lenses disposable contact lenses also require a source of eye drops such as contact lens solution for initial insertion and usually for re-wetting over the day of wear. When traveling in airplanes and air conditioned hotel rooms, the need for a source of eye drops such as contact lens solution for both permanent and disposable contact lenses is increased due to dry air.

In the event a contact lens user must remove or insert or adjust their lenses when not in a convenient location having a useable mirror, another vexing problem arises. Absent being able to view their fingers and hands and eyes in a mirror during insertion, manipulation, or removal of a contact lens from an eye, it is virtually impossible for the user to accomplish with any certainty. When in a taxi, or a restroom, or other location not at the home or office of the wearer, they may not have mirrors available for use during this procedure. Neither are there mirrors available when sitting on a plane or train, or in other situations. Consequently, contact wearers when traveling or on business or out and about, are hampered should the occasion arise where they need to manipulate or insert or remove a contact lens from their eye, and there is not useable mirror nor available source of eye drops such as contact lens solution.

The device herein provides for the transport of contact lenses in a body which is adapted to engage a larger item, preferably an eyeglass case or pouch or the like, to both keep the contacts from becoming lost in luggage or a purse. The device herein is best adapted to engage with an existing conventional eyeglass case thereby rendering it and the contents thereof, proximate during transitions between contacts and eyeglasses to enable the user to locate both their eyeglasses and their contact lenses.

In addition the device herein not only provides a configuration adapted to solidly engage with a larger object, it is configured to provide the user the ability to configure the device itself, to position a mirror for use to insert, remove, or manipulate their contact lenses when required, in any location. Still further the device herein is configured to hold a container for contact lens solution in a manner positioning the eye drop container employable for eye hydration, even while engaged securely to the device.

It should be noted, the forgoing examples of related art and limitations related therewith are intended to be illustrative and not exclusive, and they do not imply any limitations on the lens storage system and method described and claimed herein. Various limitations of the related art are already known or will become apparent to those skilled in the art upon a reading and understanding of the specification below and the accompanying drawings.

An object of the present invention is the provision of a contact lens holder and transport kit which is adapted to carry encased contact lenses and a container of eye drops such as contact lens solution in a case adapted to compressibly engage with or around larger carried object, preferably an eyeglass case.

It is another object of the invention to provide such an contact lens holder and carrying case which is configurable both for engagement to an eyeglass case, and configurable as a free standing support structure for operative use of an onboard mirror.

It is yet another object of this invention to provide such a contact lens holder which is configured to hold a supply of eye drops or lens solution in a manner allowing eye hydration with contact lens solution, without disengaging the container from the device.

Further objectives of this invention will be brought out in the following parts of the specification wherein the summary and detailed description of the invention are for the purpose of fully disclosing the invention without placing limitations thereon.

SUMMARY OF THE INVENTION

The present invention provides a contact lens transport and travel device which is adapted to engage upon an eyeglass case or the like, to maintain both eyeglasses and contacts proximate to each other during transition therebetween. The device is adapted for an encircling or compressible engagement with such an eyeglass case, which is frequently employed to safely carry eyewear such as prescription eyeglasses, sunglasses, or the like. The device features a body portion configured with storage locations to carry both contact lenses, as well as hold a container of wetting solution in a position enabling use of the wetting solution without disengagement thereof from the body.

In one mode of the device, the body in various configurations may be formed of leather, canvas, or rugged synthetic textile material such as CORDURA, which forms a flexible body, adapted for an encircled frictional engagement around an eyeglass case or the like. By engagement of two ends of the body, or overlapping two biasly curved ends of the body while encircling an eyeglass case, a frictional encircling engagement of an eyeglass case is easily achieved.

In another mode of the device, all or a portion of the flexible body of the device, may be configured of textile or other fabric which is elastic and thereby be stretchable during engagement to surround a mount such as an eyeglass case. In this mode using elastic fabric, as the elastic material contracts once engaged around the object such as an eyeglass case, the body achieves a biased compressive engagement thereround. By encircled engagement of the eyeglass case, the device and the contained contact lenses and lens solution are maintained proximate to the eyeglasses of the user during transition between eyeglasses and contact lenses.

Such eyeglass cases are formed to hold and protect eyeglasses within an interior cavity and average approximately five inches to seven inches in length and seven inches to eleven inches in circumference at a mid section. Consequently, the body of the contact lens holder herein, when formed of leather or non elastic textile or non woven material, would have an interior circumference which may be equal to or slightly larger to the circumference of an eyeglass case intended, sufficient for a frictional engagement thereround. In a mode including metal members running axially through both ends of the device, it can be adapted in length to allow an overlapping engagement of both ends around a wide variety of eyeglass cases having a wide variance in circumference length.

In an alternative, where elastic fabric is included in the body of the device, the interior circumference of the body with ends engaged may be smaller than the exterior circumference of the eyeglass case. Such will allow the body to be stretched over the eyeglass case and retract to a biased compressed engagement about the circumference. The entire body need not be formed of elastic material, just a sufficient portion to contract the body to the biased engagement.

As noted, a currently preferred material for the body of the device is one or a combination of leather and CORDURA, or similar textile fabrics adapted to a configuration of the device which is non elastic but may either elongate slightly when pulled to an engagement around an eyeglass case, or may have overlapping curved ends which adjust to different circumferences of the eyeglass case.

Should elastic material be included as a portion of the body of the device, neoprene, or other material having elastic properties such as spandex or other textile fabrics formed one or a combination of woven, knitted, or laminated elastic fabrics, will work well to achieve the elongation for a biased compressive circumferential engagement of an eyeglass case. Such elastic material works well also to hold a liquid solution bottle.

While shown herein in a preferred mode with a body having overlapping engageable opposing ends which form a circular configuration and engagement when connected around an eyeglass case, the body could be formed as a single circular component either by forming it as such with an elastic section. Additionally, the body could be formed in a complete circular configuration by knitting or other methods, and subsequently simply be enlarged while being slid over an object such as an eyeglass case to achieve a biased engagement thereon.

As shown in the figures, in the mode of the device with overlapping ends, the body of the device has opposing ends each adapted with mating connectors for removable engagement to each other, or overlapping each other, to allow the user to encircle an object or eyeglass case. The overlapping of both ends provides a means to adjust the interior circumference of the body of the device to surround eyeglass cases having differing sized exterior circumferences.

If an elastic portion or configuration of the body is employed, the user may stretch the elastic portion of the body and secure the two ends to each other around the eyeglass case. The ability to secure both ends to each other also allows the device to be configured as a mirror support, for the user to view their eyes, when not in an engaged configuration surrounding an object such as an eyeglass case.

Positioned on a first side surface of the body is a pocket. This pocket is adapted to hold a contact lens case therein. Such allows the device to store and transport the case easily and safely. This first side surface is exposed with the body in a circumferential engagement around an object such as the eyeglass case, and allows the user to remove the contact lens case without disengaging the body from the eyeglass case, if desired.

On a second surface of the body opposite the first surface, is positioned a mirror. In all modes of the device herein, whether depicted or not, the mirror may be permanently engaged to the body of the device or optionally, the mirror may be removably engaged. Such a removable engagement is accomplished by positioning a perimeter edge of the mirror in a sandwiched engagement between the second surface and an elastic lip having an exterior perimeter engaged with the body. Such would allow the user to easily remove the mirror if desired for use elsewhere, or to replace it should it become damaged.

The two opposing ends of the body of the device have fasteners thereon which are complimentary, such that they will removably engage to hold a first end to the second end. Such complimentary fasteners may include one or a combination of complimentary fasteners from a group including hook and loop fabric, clips, buttons, snaps, hooks, biased overlapping ends, or other mating fastenings which are complimentary and configured to releasably engage.

Particularly preferred, for a releasable engagement of both ends, are the employment of metal or other members engaged axially within the two opposing ends, such as spring steel, or carbon fiber or fiberglass or the like. In this mode, the elongated arched or arching members are engaged within cavities formed axially at both of two ends of the body of the device. The members, if manually extended to a straight or planar configuration, will maintain that position and will hold one or both ends planar. Curved member are particularly preferred for this endeavor. This configuration is easily overcome by the user bending the ends to bend the elongated members therein, whereupon they cause the end to curl, and wrap under or around the other end of the body, to hold the body in a compressive encircled engagement around the eyeglass case. This mode also allows for elongated ends which will self adjust around the eyeglass case in the compressive engagement, allowing for visually an infinite adjustment.

Also preferred in all modes of the device herein, is a second pocket which is adapted to hold a fluid container such as those available for contact lens solution or re-wetting drops used with contact lenses. In all preferred modes of the device herein, this second pocket is positioned on the body of the device, such that an elastic opening for insertion and removal of the fluid bottle, runs along a side edge of the body. This is preferred as it allows the fluid bottle to be engaged and removed, from a side edge.

This positioning of the fluid container within the flexible confines of the fabric or elastic pocket, allows the user to dispense fluid drops from the fluid container without disengaging the bottle from its pocketed engagement with the body of the device, and is especially useful. This second pocket is preferably also formed of stretchable or elastic fabric to allow for easy insertion and removal of the bottle and to form a secure compressive biased engagement of the sidewall of the second pocket around and against the exterior of the bottle when inserted.

Additionally, while optional, it may be desirable to include a third pocket having a transparent sidewall on one end of the body. Such is preferable as it provides a place to store the user's identification, should the device become lost or instructions on use of the contact lenses which may be read through the transparent wall of the pocket and protected from moisture such as from the contact lens solution of the fluid container.

Finally, another optional component is the inclusion of one or a package of micro fiber cleaning cloths. When transitioning from contact lenses to eyeglasses, the availability of a cleaning cloth for the eyewear lenses is preferable since such may be smudged or dirty. Currently, an elastic band provides a secure removable engagement for either one or a plurality of micro fiber or other cleaning cloths to the device.

With respect to the above description, before explaining at least one preferred embodiment of the herein disclosed contact lens transport and storage system device in detail, it is to be understood that the invention is not limited in its application to the details of construction and to the arrangement of the steps in the following description or illustrated in the drawings. The invention herein described is capable of other embodiments and of being practiced and carried out in various ways which will become obvious to those skilled in the art on reading this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other contact lens carrying and storage systems and for carrying out the several purposes of the present disclosed system. It is important, therefore, that the claims be regarded as including such equivalent construction and methodology insofar as they do not depart from the spirit and scope of the present invention.

BRIEF DESCRIPTION OF DRAWING FIGURES

FIG. 1 depicts the device with the body of the contact lens carrying device herein having an elastic portion, in an engaged position with an eyeglass carrying case.

FIG. 1*a* shows the device with the body of the contact lens carrying device formed of non elastic material and in an engaged position with an eyeglass carrying case.

FIG. 2 depicts the device of FIG. 1, from an opposite end and showing the cooperative removable engagement to the two ends of the body of the device to achieve the compressibly biased circumferential engagement around the eyeglass case or other object.

FIG. 3. shows the flexible body of the device disengaged from the circumferential engagement with the eyeglass case.

DETAILED DESCRIPTION OF THE PREFERRED EMBODIMENTS OF THE INVENTION

Figure 1:
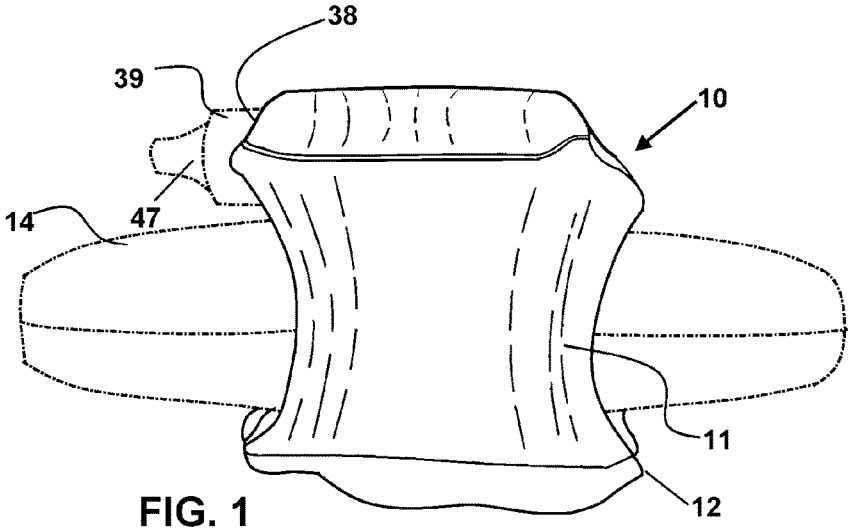

In this description, any directional prepositions if employed, such as up, upwardly, down, downwardly, front, back, first, second, top, upper, bottom, lower, left, right and other such terms refer to the device or depictions as such may be oriented are describing such as it appears in the drawings and are used for convenience only. Such terms of direction and location are not intended to be limiting or to imply that the device herein has to be used or positioned in any particular orientation.

Now referring to drawings in FIGS. 1-17 there is seen in FIG. 1, the flexible body 12 of the contact lens carrying device 10 herein. As shown in a preferred mode of FIG. 1, the body 12 may have at least one elastic portion 11 which, if present, stretches during engagement with the eyeglass case 14 and is in a compressibly biased engagement surrounding the circumference of the object such as an eyeglass carrying case 14.

Figure 2:
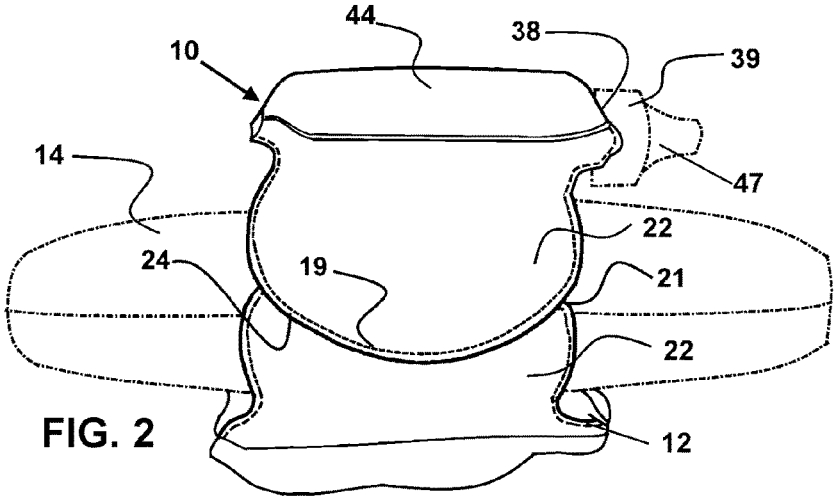

The body 12 in this mode with an elastic portion 11 is thus adapted in length such that when placed in the engaged position around an eyeglass carrying case, shown in FIGS. 1 and 2, one or more elastic portions 11 of the body 12 are stretched and bias portions of the body 12 inward and against the carrying case 14 or similar object when stretched thereround. The elastic portions 11 of fabric forming the body 12 can also be positioned at or adjacent a first end 19 and/or second end 21 (FIG. 5) of the flexible body 12. Since the body 12 is sewn from leather, or CORDURA, or other flexible materials, positioning of elastic portions 11 formed for example of an elastic fabric such as neoprene or spandex or the like, can easily be done.

Figure 1A:
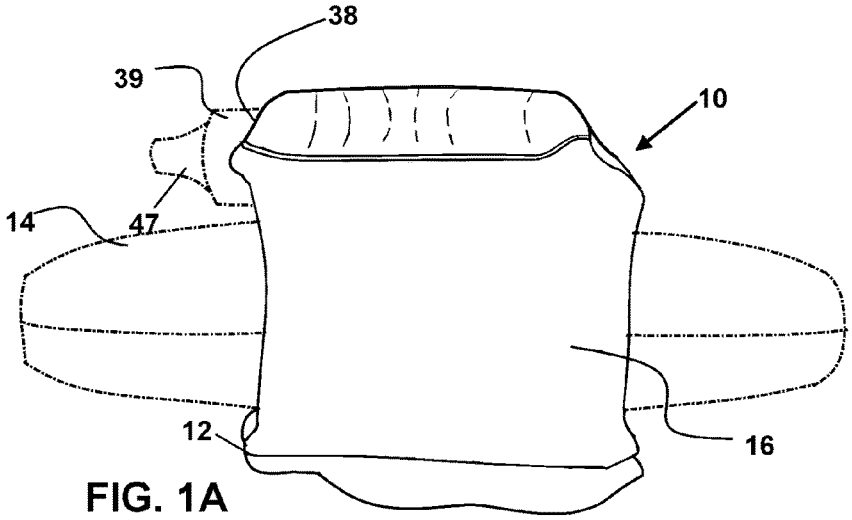

Shown in FIG. 1A, is a mode of the device 10 wherein the body is formed of leather, or CORDURA, or other woven, non-woven, or laminated materials or flexible materials 16 which may not be elastic in the manner of that of FIG. 1, but would still have a slight inherent ability to stretch or elongate during the encircling and engagement around the object such as an eyeglass case 14. In all modes of the device 10 herein the body is adapted for an encircled engagement around the eyeglass carrying case 14 with the first end 19 and second end 21 removably engaged.

Using either a body 12 having an elastic portion 11 or simply formed of flexible material 16, the length of the body from the first end 19 to the second end 21 is adapted such that when positioned in an engaged position as in FIG. 1, an opening 15 (FIGS. 8, 12 and 17) communicating through the body 12 with engaged ends is formed. This opening 15 defines an interior circumference of the engaged body 14, for positioning around an object such as the eyeglass case 14, which should be equal to or slightly smaller than a circumference of the eyeglass case 14.

Thus, with the cooperative fasteners 24 engaged to hold both the first end 19 and second end 21 of the body 12 engaged, when the opening 15 of the body 12 is stretched over the case 14, the mode of the body 12 with one or more elastic portions 11 will contract and impart a compressive bias of the body 12 surrounding the opening 15 of the engaged body 12 against the exterior of the eyeglass case 14. When the cooperative fasteners 24 at both the first end 19 and second end 21 are removably engaged to hold flap portions at the first end 19 and second end 21 engaged and overlapping, a distance of this overlap can be adjusted to change the size of the opening 15. This is easily done using hook and loop fabric for the cooperative fasteners 24, which will provide engagement of the ends in an adjustable overlap. In the mode of the body formed of flexible material 16, such inherently will stretch slightly during engagement of the fasteners at the first end 19 and second end 21 and provide a frictional biased encircled engagement of the eyeglass case 14.

Figure 3:
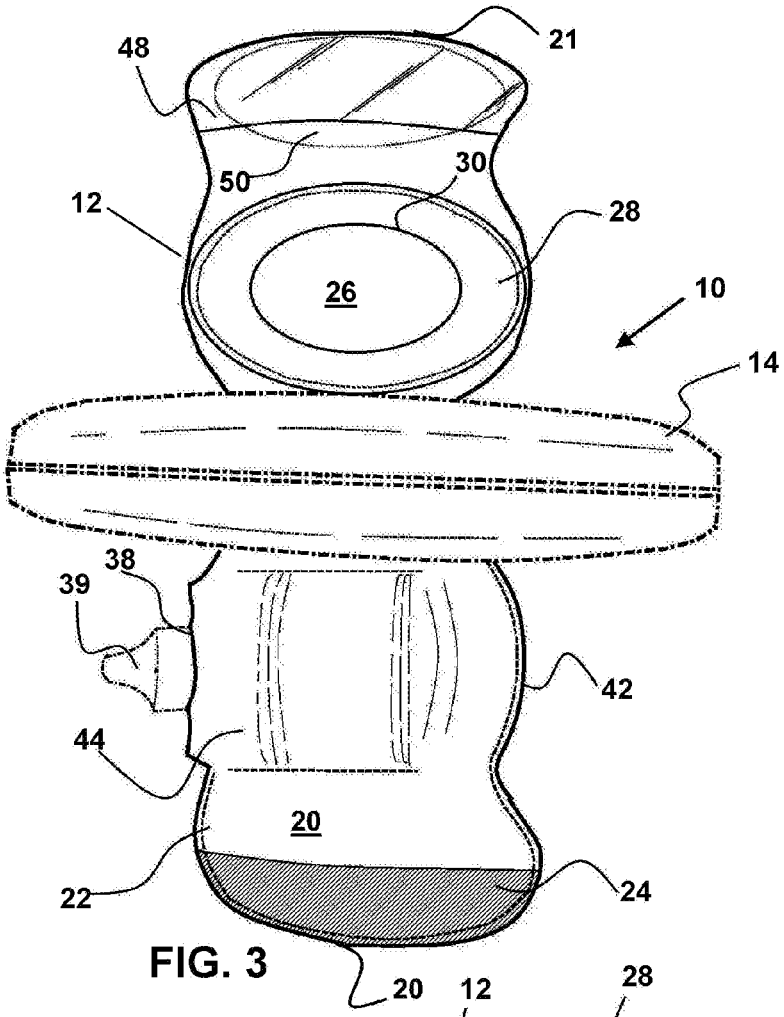
Figure 5:
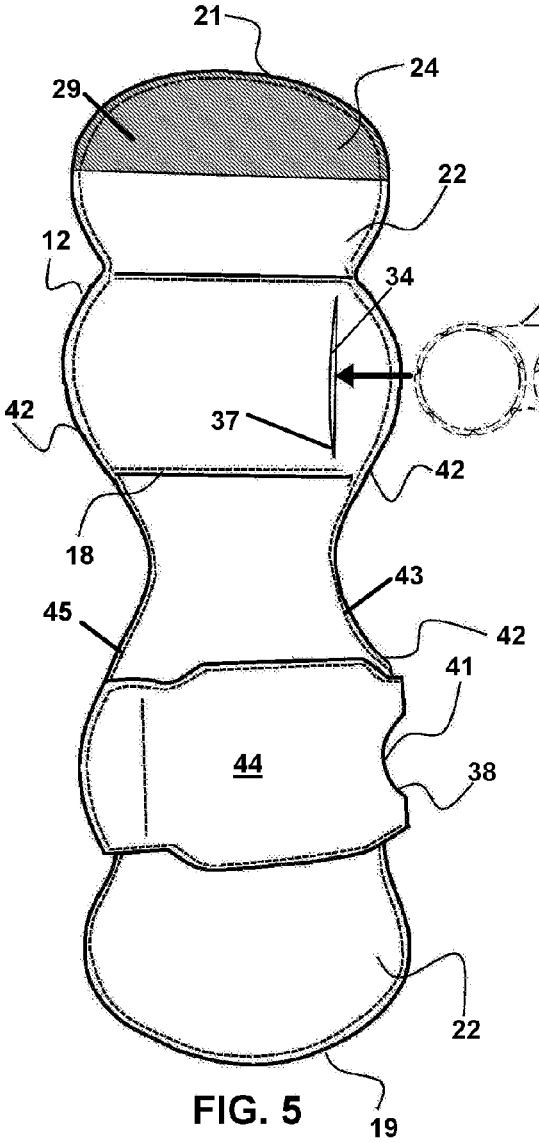
FIG. 5 depicts an overhead view of the first side surface of the body of the device, showing the first pocket adapted to hold a contact lens case and showing the side edge positioned opening for the second pocket adapted to hold the fluid container.
Figure 6:
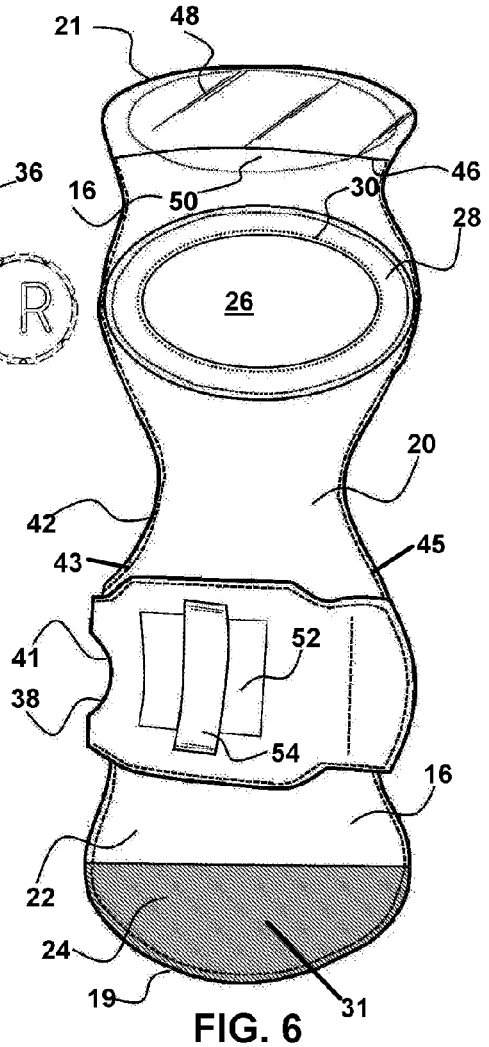
FIG. 6 shows an overhead view of a second side surface of the body of the device showing the mirror which may be removably engaged using a circumferential elastic lip and showing the elastic band for holding one or a plurality of cloths.

Shown in FIG. 2, and also in FIGS. 3, and 5-6, the first end 19 and second end 21 of the body 12 can be configured at each of the two ends with flap portions 22 configured for an overlapping engagement. As depicted in FIG. 2, these two ends or the flap portions 22 at both the first and second ends, may have cooperative fasteners 24 thereon configured for removable mating to hold opposing sides of the body in an engagement with each other. As shown in an overlapped engagement, as in FIG. 2 or 12, the cooperative fasteners 24 positioned on each of the two ends of the body, removably engage to maintain this overlapped engagement. As noted, such cooperative fasteners 24 may be hook and loop fabric as shown in FIGS. 5-6 at both ends of the body, or hooks, buttons, snaps, clips, or elongated members engaged with or within both ends of the body, which hold a curved configuration or other cooperative fasteners located at both ends of the body, as would be employed by one skilled in the art.

Depicted in FIG. 3 is the flexible body 12 of the device 10 in a disengaged position but ready for positioning to the engaged position, in a curved or circular configuration with said first end 19 removably engaged with said second end 21 as shown in FIGS. 1-2 or FIG. 4 or 12. In this circular configuration, the body 12 forms a frictional or biased compressive engagement surrounding the eyeglass case 14 such as in FIG. 1-2 or 12 or with the first end 19 and second end 21 engaged or overlapped to form a self-supporting structure as in FIG. 4, 12, or 17. As shown in FIG. 3, the body 12 is in position for the user to connect the cooperative fasteners 24 at both the first and second ends 19 and 21, and thereby removably engage the body 12 around the eyeglass case 14, such as in FIGS. 1 and 2 or to form the self supporting structure for upright positioning of the mirror 26, elevated above a support surface.

Figure 4:
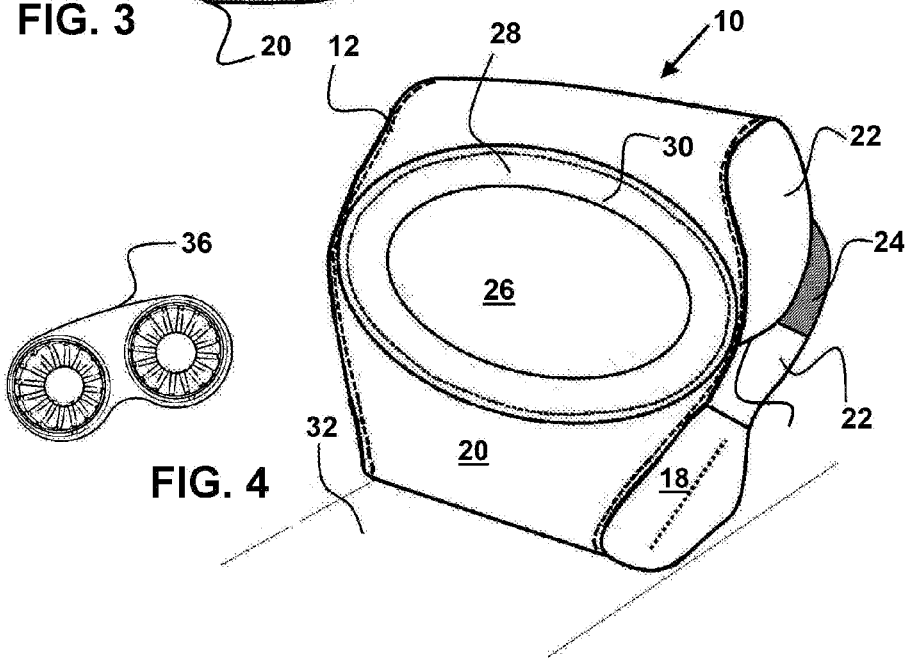
FIG. 4 shows the flexible body of the device, with ends engaged and functioning as a mirror stand by holding the engaged mirror in position for use by the wearer and showing the contact lens case engageable with the first pocket.

Also as shown in FIGS. 3 and 4, is a preferred configuration having a mirror 26 engaged to the second side 20 of the flexible body 12. In one mode of the device 10 the mirror 26 might be permanently engaged with adhesive, or in another mode, the mirror as noted, can be removably engaged to allow removal from the device 10.

In a removable engagement, the mirror 26 can be engaged about the perimeter by an elastic lip 28 attached to the first side 18 or surface of the body 12, and extending across a width to an opposite edge defining an aperture 30 formed at an interior perimeter. In this configuration with the elastic lip 28, the mirror 26 is held against the side surface of the body 12 by the elastic lip 28 but can be removed for use away from the body 12 and reattached if desired.

As shown in FIG. 4, the device 10 as noted above, is configurable to form the body 12 in the circular configuration to form a stand or mount. In this circular configuration, as a mount, the mirror 26 is positioned above the support surface 32, and positionable at an upward angle relative to an underlying support surface 32, such as a table or counter top. This is done by forming the body 12 to the circular configuration and placing a portion of the first side 18 of the body 12 on the support surface 32 to position the mirror 26 at the desired angle to the user.

In this mode the cooperative fasteners 24 on each of the two ends 19 and 21 or flap portions, are engaged, and the flexible body 12, if employed, is positioned to place the mirror angling upright from the support surface 32 for the user to employ to insert or remove or adjust their contact lenses, apply makeup, or for other functions. In this position, a rotation of the body 12 on the support surface 32 allows the user, there above, to adjust an angle of the mirror 26 relative to the user. Optionally, stiffeners such as the elongated member 56 of FIG. 15A, may be positioned in-between the first surface 18 and second surface or side 20 in the area of the flap portions 22, which will stiffen both flap portions 22 of the two ends 19 and 21 and increase stability of the body 12 when in the stand mode, for positioning the mirror 26 for use, of FIG. 4. Shown in FIGS. 5, 7 and 11, on the first surface 18 of the body 12 is located a first pocket 34 having first pocket opening 37 and interior cavity adapted to hold a contact lens case 36 removably therein for storage and transport with the device 10. This positioning of the first pocket 34 is preferred since the first side 18 of the body 12 may be exposed during circumferential or a circular configuration, in an engagement with an object such as the case 14. As noted, this positioning allows the user to remove the contact lens case 36 without disengaging the body 12 if desired.

Also shown in FIGS. 5 and 6, the cooperative fasteners 24 adjacent the first end 19 and second end 21 of the body 12, which as depicted are hook 29 and loop 31 fabric type fasteners.

Figure 7:
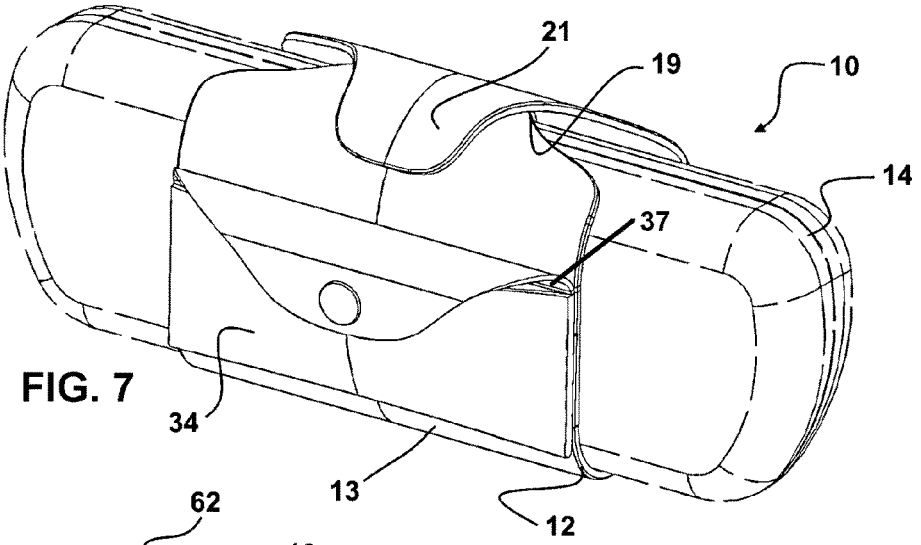
FIG. 7 depicts a perspective view of an especially preferred mode of the device in an engaged position with opposing ends of the body of the device, held overlapping by elongated members which are axially held in a recess at each end.
Figure 8:
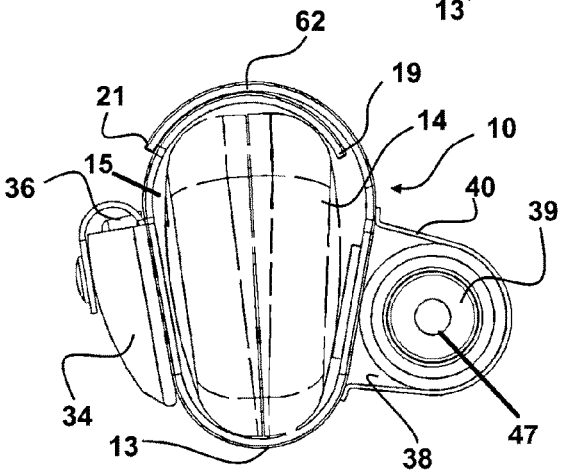
FIG. 8 depicts an end view of the device as in FIG. 7 and shows how the body forms a stand supported on one side by the first pocket holding the contact lens case and second pocket holding the fluid container.
Figure 16:
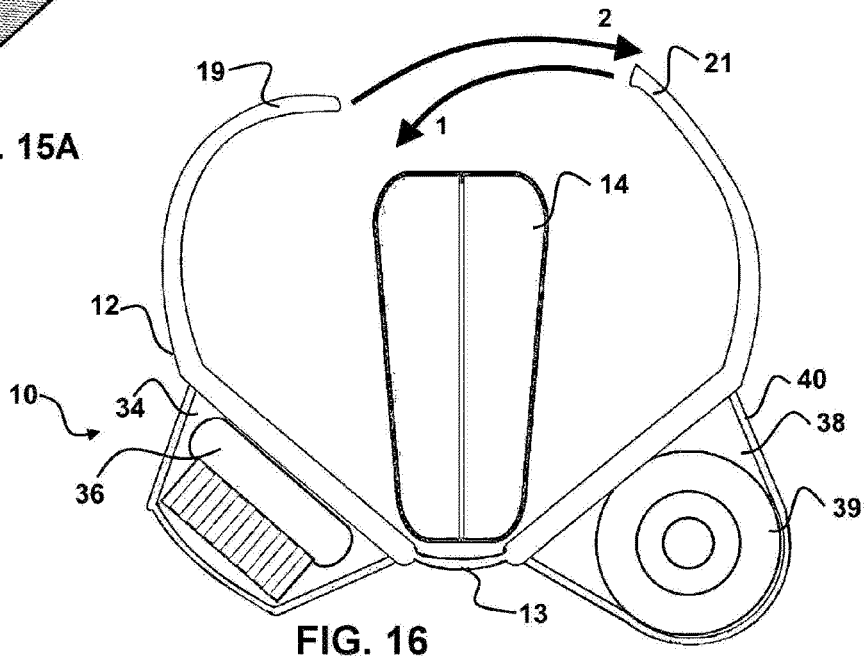
FIG. 16 depicts the body moving to a curved overlapping engagement of both of the two ends thereof, by curving both ends and rotating a first end around the eyeglass case and a second end overlapping the first end.
Figure 17:
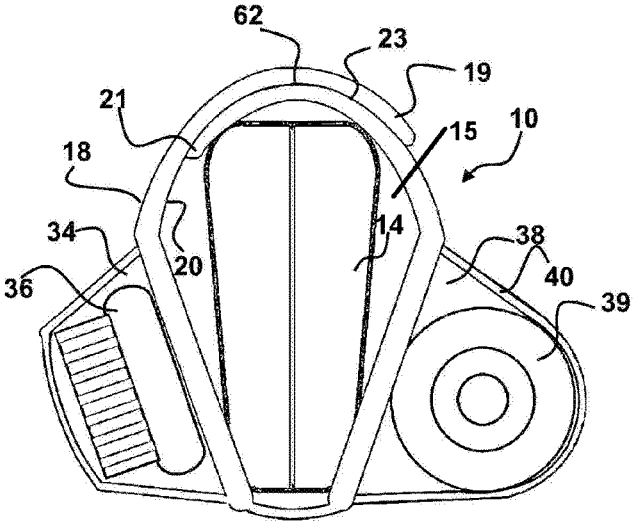
FIG. 17 shows the curved overlapping compressive engagement of the two ends with each other and against the exterior surface of an object such as the eyeglass case and being held in the compressive overlapping engagement by the two elongated members moved to their respective curled configuration to impart a biased curved or encircled engagement of the case in an opening surrounded by the body.

Using this hook 29 and loop 31 for the cooperative fasteners 24 allows for an overlapped removable engagement with an adjustable overlap of a first flap portion adjacent said first end 19 and a second flap portion of said body adjacent said second end 21, such as shown in FIGS. 7-8. This is because the hook and loop fabric will removably engage across the entire area of each. This removable engagement allows for the adjustment of a distance of the overlap of the two ends, which will concurrently adjust the size of the opening 15 of the body 12 when engaged in the circular configuration of FIG. 8 or 12. This same adjustment of the overlap is provided by the use of the elongated members 56 shown in FIG. 15A when engaged at both ends of the body 12 as in FIGS. 10-11. When both elongated members 56 are moved to the curled configuration from the elongated configuration, they curl the end of the body 12 to which they are engaged, and allow for adjustment of the overlap of the two ends as shown in FIGS. 16-17.

Shown in FIG. 6 is the second surface or second side 20 of the body 12 opposite the first side 18. Also shown in both FIGS. 5 and 6 is a second pocket 38 positioned on one or between the first side 18 and second side 20 of the body 12, which is configured to hold a fluid container 39 (FIG. 8) such as those available for contact lens solution used with contact lenses. The material forming the body 12 in the formed second pocket 38 has at least one side surface 44 (FIG. 5) or sidewall of the second pocket 38 formed preferably of elastic material, whereby all or a portion of a second pocket opening 41 will stretch. This allows a fluid container 39 of lens solution as shown in FIG. 8 to be positioned within the second pocket 38 with the dispensing end of the fluid container 39 projecting from the second pocket opening 41 with the cap 47 on the fluid container 39 exposed as in FIG. 1. Such allows removal of the cap 47 and dispensing of fluid from the container 39, without removing it from the second pocket 38.

It is preferred, this second pocket 38 is positioned on the body 12 of the device 10, wherein the second pocket opening 41 to the interior cavity of the pocket 38, through which insertion and removal of the fluid container 39 passes, runs adjacent a first side edge 43 opposite a second side edge 45, forming part of the perimeter edge 42 of the body 12. This positioning adjacent on the side edge is preferred as noted above, as it allows the fluid container 39 to be engaged and removed, through the second pocket opening 41 on or adjacent the perimeter edge 42 while the body is engaged to an eyeglass case 14. More importantly, this side edge positioning allows the user to remove the cap 47 on the fluid container 39, and dispense drops of a contact lens solution from the pocket-housed fluid container 39, without removing the fluid container 39 from the second pocket 38, and without disengaging the device 10 from the engaged position around an eyeglass case 14.

In an optional but desirable mode of the device 10, a third pocket 46 having a transparent sidewall 48 is positioned on one end of the body 12. Such is preferable, as it provides a place to store a readable card 50 which might be a user ID or instructions on use of the device 10 or its parts, all of which may be viewed or read through the transparent wall 48 of the third pocket 46 and thereby protected from moisture.

Additionally shown is another optional component for engagement and inclusion with the device 10 is one or a package of cleaning cloths 52. As noted above, during transition from contact lenses to eyeglasses, the availability of a cleaning cloth 52 for the eyewear lenses is preferable since such may be smudged or dirty. Securement is provided by an elastic band 54 to yield a removable engagement for the cloth 52.

Shown in FIG. 7, is a perspective view of an especially preferred mode of the device 10 herein. As shown the body 12 in an engaged position in a frictional circumferential engagement around the exterior surface of an object such as the eyeglass case 14. As shown, flap portions 22 of the second end 21 overlaps that of the first end 19 in a curved overlapping compressive engagement there-against. The compressive overlapping curved engagement may be reversed with the first end 19 overlapping the second end 21.

Figure 14:
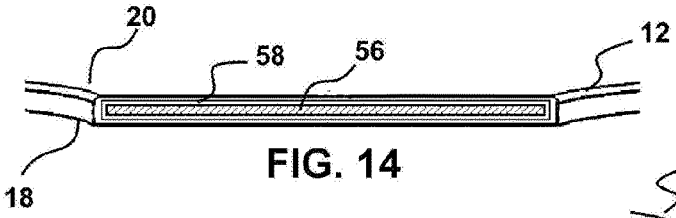
FIG. 14 shows a sectional view through either of the two ends of the body of the device of FIG. 7-13, showing the elongated member held within a formed cavity in-between the first side and second side of the body.
Figure 15:
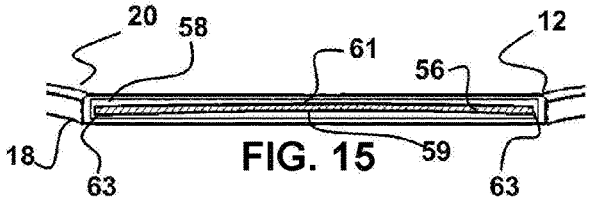
FIG. 15 depicts the preferred configuration of the elongated member as being curved or arched along substantially its entire length in a configuration which will hold a planar elongated configuration to maintain an end of the body planar as in FIG. 13.

Both the first end 19 and the second end 21 are held in this biased or compressive contact against each other as shown in FIGS. 7-9 and 12, by the cooperative fasteners 24 which in this mode are provided by elongated members 56, each held in an internal cavity 58 or pocket in-between the first side 18 and second side 20 of the body 12 as shown in FIGS. 14-15. As noted, these elongated members 56 run axially through both the first end 19 and second end 21 and extend along a central axis of the body 12 from the respective distal ends 60 of both the first and second ends. Each of the two elongated members has a length substantially ¼ to ½ the entire length of the body 12 between the distal ends 60 of the body at both the first end 19 and second end 21. By substantially is meant plus or minus 25% since for some engagements a more compressive curved engagement is needed and in some less.

Figure 13:
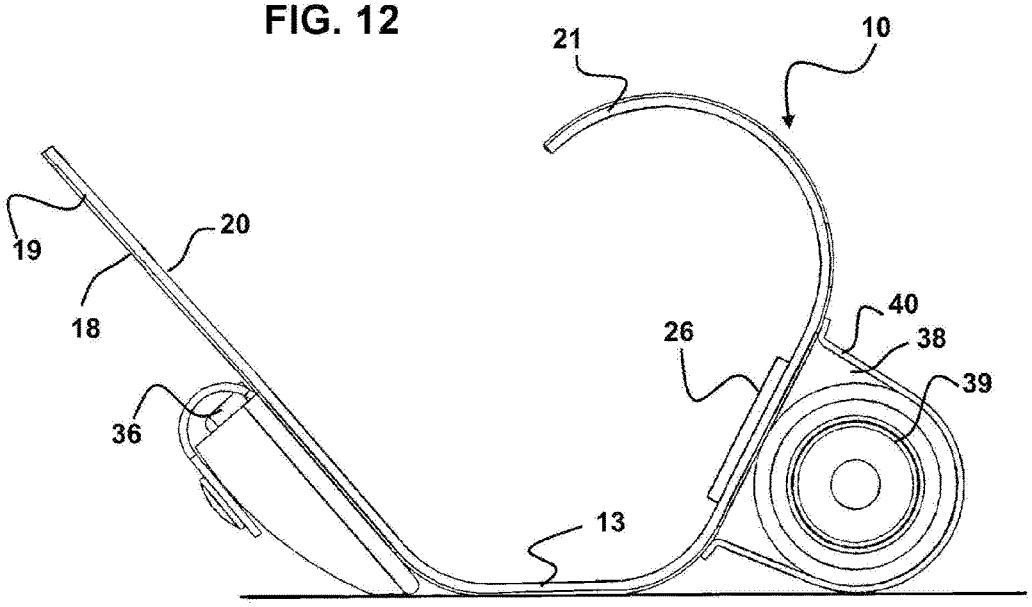
FIG. 13 shows the device of FIG. 12 wherein one end of the body has been pulled from the overlapping engagement with the opposite end and is held in a substantially planar positioning by the internally housed member which may be curved or arched or may form a curve or arch as in FIG. 15 to maintain this configuration.
Figure 15A:
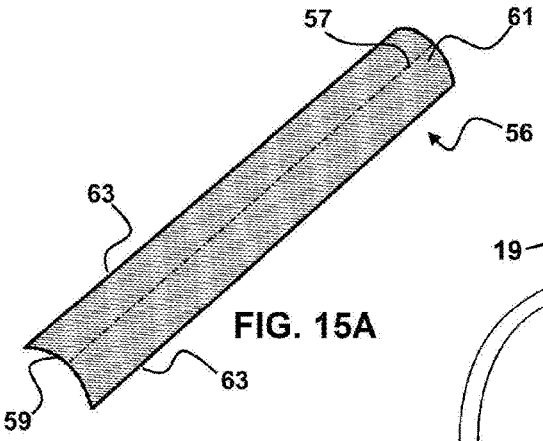
FIG. 15A depicts the elongated member, as in the other figures herein, moved to an elongated configuration which is linear, as in FIGS. 10-11 and 13, from the curved configuration of FIGS. 12 and 17 where the elongated member biases and holds the opposing ends in a compressive engagement around an object.

In all modes it is preferred that the elongated members 56 are formed of spring material or memory material having a curved configuration which, unless positioned to hold a substantially planar elongated configuration as in FIG. 13 or 15A, will bias to a curled configuration shape inside the walls of the body of the device such as in FIG. 17. For example, spring steel or synthetic materials such as carbon fiber or fiberglass may be employed for the elongated members 56 as they can be formed always bias to a curved shape when not held in the substantially planar elongated configuration of FIG. 13. Particularly preferred, are the employment of arched or curved elongated members as in FIGS. 15 and 15A, wherein a central portion 61 of the elongated member 56 running along its axis 57, arches in a curve 59 to a position where the central portion 61 along the axis 57 is located on a different plane, from that occupied by both of the two side edges 63 which run parallel on the same plane as each other.

This curved the elongated member 56 will move under force between a first or substantially planar elongated configuration as in FIG. 15A, to a second or curled configuration within the opposing ends of the device 10 and holding them overlapping portions curved or curled and compressively contacting each other, and any object the body encircles in the opening 15. The elongated member can be straightened to the planar elongated position of 15A from this curled position by user force. This curled configuration of the elongated member 56 with the two side edges 63 in a first plane and the central portion 61 running along the axis 57 in a second plane, which causes it to stay in one of either the substantially planar elongated configuration or the curled configuration once placed in such configuration by user force.

The employment of such elongated members 56 with a curve 59 in configuration for the cooperative fasteners 24 to hold the two ends of the body 12 wrapped around the eyeglass case 14 is preferred because the members 56 are, as noted, formed to have a bias or memory, causing them to continually form a biased curled configuration where at least one end of the two ends of the elongated member 56 curves toward the other end of the elongated member 56. This curved shape axially of the elongated member 56 resists moving back toward the elongated configuration and imparts a biasing force to maintain the curved or encircled shape of the device 10, and thus forms the cooperative fasteners for the two ends of the body 12 to maintain them both in a curved overlapped engagement such as in FIG. 12.

Figure 12:
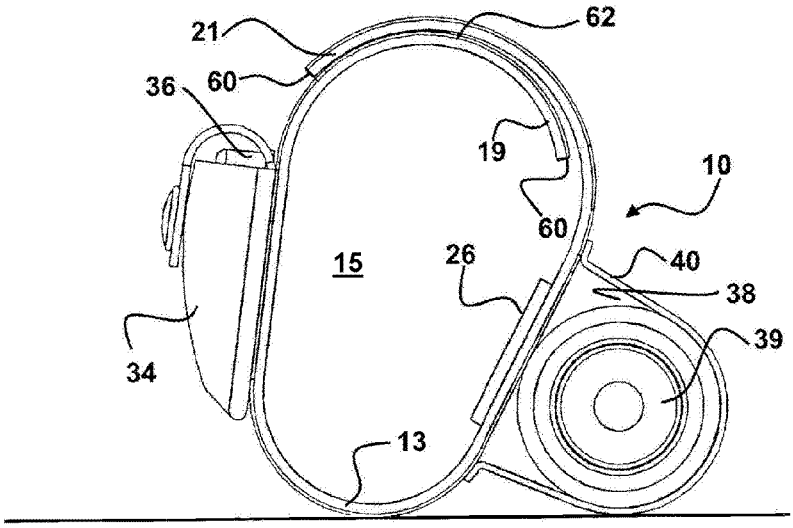
FIG. 12 shows the device of FIG. 7 without the eyeglass case engaged, showing the overlapping curved compressive engagement provided by the elongated members axially engaged at both ends of the body.

As noted, this engagement may be overcome by the user pulling on either the first end 19 or second end 21 to disengage the overlap by rotating the body in the central portion 13, or to straighten one of the elongated members 56 as in FIG. 13, whereupon the body 12 rotates on a central portion 13 and disengages the biased overlapped engagement of the two ends shown in FIG. 12.

Either of the elongated members 56 having the curve 59 shape, will hold this straightened configuration and hold one or both ends of the body 12 in the depicted substantially planar configuration such as shown in FIG. 13, until a force to re-curve the member 56 such as the urging of the user or another force acting on the distal end 60 of either end of the body 12 with the member 56 therein, causes the member 56 and the surrounding end of the body 12 to move to the curled configuration and re-curve. By substantially planar is meant flat, or in the slightly curved configuration of FIG. 12 where the two ends are curved to substantially the same curved configuration and overlap.

When in the overlapped engagement of the first end 19 and second end 21, the cooperative fasteners provided by both elongated members 56, will as noted, continue to hold both the first end 19 and second end 21 in this biased curved engagement with the body 12 wrapped around the eyeglass case 14 in a compressive configuration. Further, this biased overlapped engagement of both ends which is shown in FIG. 12, is slidingly adjustable, to adjust the distance of overlap of both ends 19 and 21, which will be held in place by the elongated members 56 forming the cooperative fasteners, thereby providing a means for adjustment of the opening 15 interior circumference of the surrounding body 12.

This sliding adjustment of both ends past each other while engaged with each other and held there by the members 56 in the curved configuration, allows the body 12 to adjust in circumference, to frictionally engage the interior surface of the body 12 against and around the circumference of the surface of an object just as the eyeglass case 14 by sliding one end over the other in this overlapped engagement.

Since both ends 19 and 21 resists uncurling, due to the inclusion of the member 56 or preferably with a curve 59 therein, the body 12 will remain in an encircled engagement around the eyeglass case 14 or other object, until one of the two ends is lifted off the other so it may slide over the high point 62 (FIG. 12) of the engagement therebetween.

As noted, FIG. 8 shows an end view of the device 10 as in FIG. 7 and shows how the body 12 will form a stand which is supported on one side by the first pocket 34 holding the contact lens case 36 and second pocket 38 holding the fluid container 39. This stand configuration is most useful as shown in FIG. 13, where the device 10 has been dismounted from the eyeglass case 14 and one end moved to the elongated or planar configuration. The stand, in this mode, allows the user to use the mirror 26 which is shielded from other light and reflections by the overhanging second end 21 still biased to the curved configuration.

Figure 9:
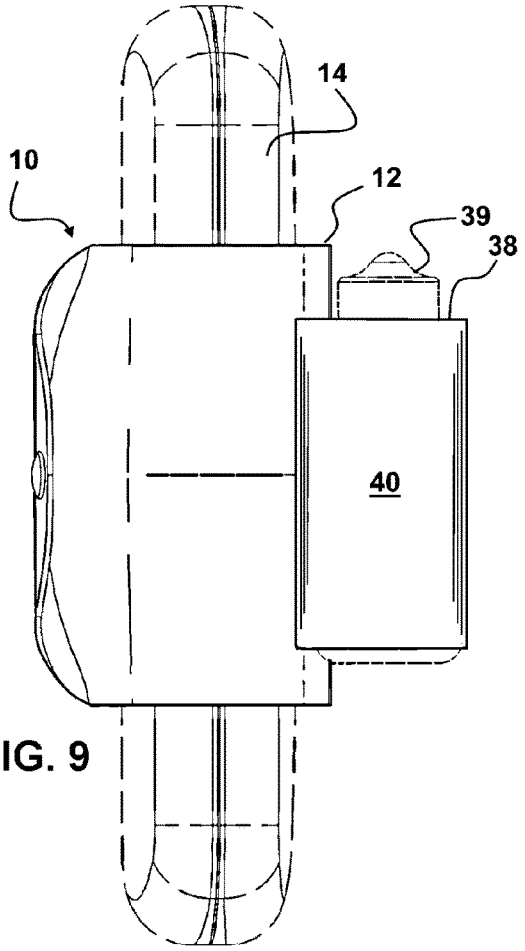
FIG. 9 shows a side view of the device of FIG. 7 and shows the fluid container compressively engaged in the second pocket.

As also noted, FIG. 9, depicts a side or end view of the device 10 of FIG. 7. As shown, the fluid container 39 is compressibly engaged within the elastic sidewall 40 forming the second pocket 38. The second pocket 38 thus is configured to compressibly engage a fluid container 39 therein.

Figure 10:
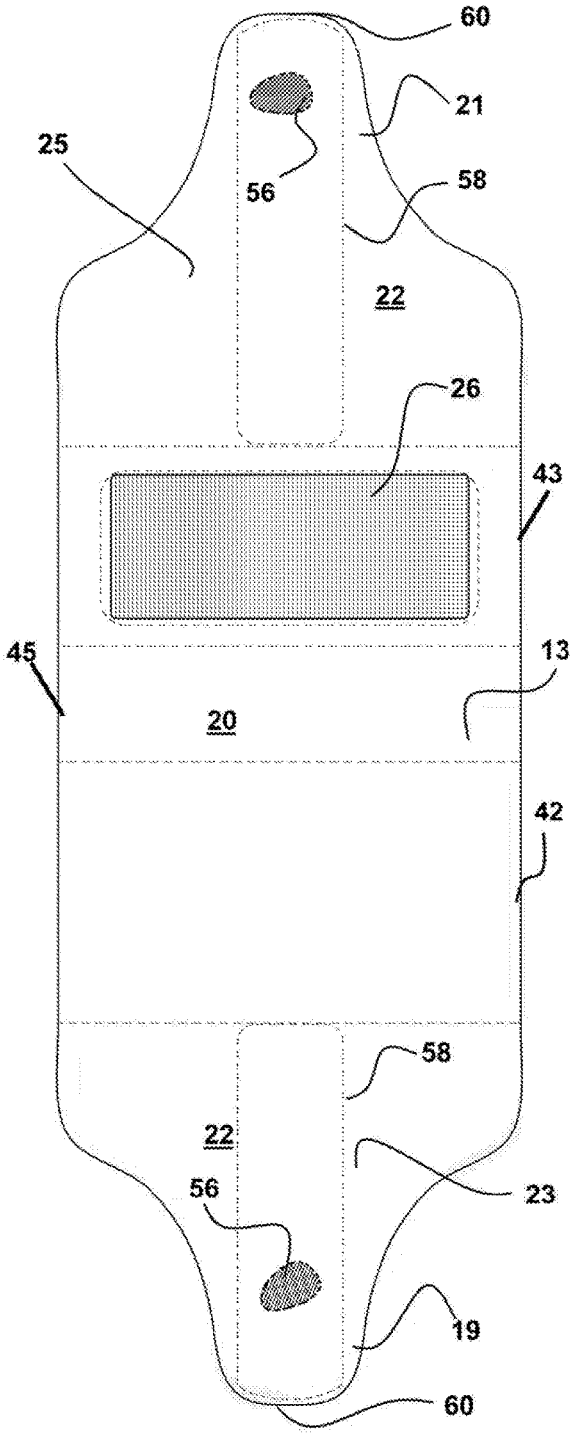
FIG. 10 depicts an overhead plan view of the second side of the body of the device of FIG. 7, showing the mirror, and also showing elongated members running axially and positioned in cavities of the body at both ends.

Shown in FIG. 10 is an overhead plan view of the second side 20 of the body 12 of the device of FIG. 7, showing the mirror 26, and also showing elongated members 56 running axially and positioned in cavities 58 positioned in-between the first and second sides of the body 12 at both the first end 19 and second end 21. Also shown is a central portion 13 of the body situated in-between the first and second ends. On the first end 19 is shown a first overlap area 23 of the second surface 20 which is defined as the area within the perimeter 60 of the body 12 for the length of the cavity 58 enclosing the member 56 to the distal end 60, and provides the frictional biased contact against the first side surface 18 when engaged there over. On the second end 21 is shown a second overlap area 25 of the second surface 20 which is defined by the area within the perimeter 42 of the body 12 for the length of the pocket or cavity 58 enclosing the member 56 at the second end 21 to the distal end 60 of the second end 21. This second overlap area 25 provides the frictional biased contact against the first side surface 18 at the first end of the body 12 when engaged there over. As noted, either end can be engaged over the other to form this overlapped biased curved engagement of both ends of the body 12 of the device 10 to the other, and around an object such as the eyeglass case.

Figure 11:
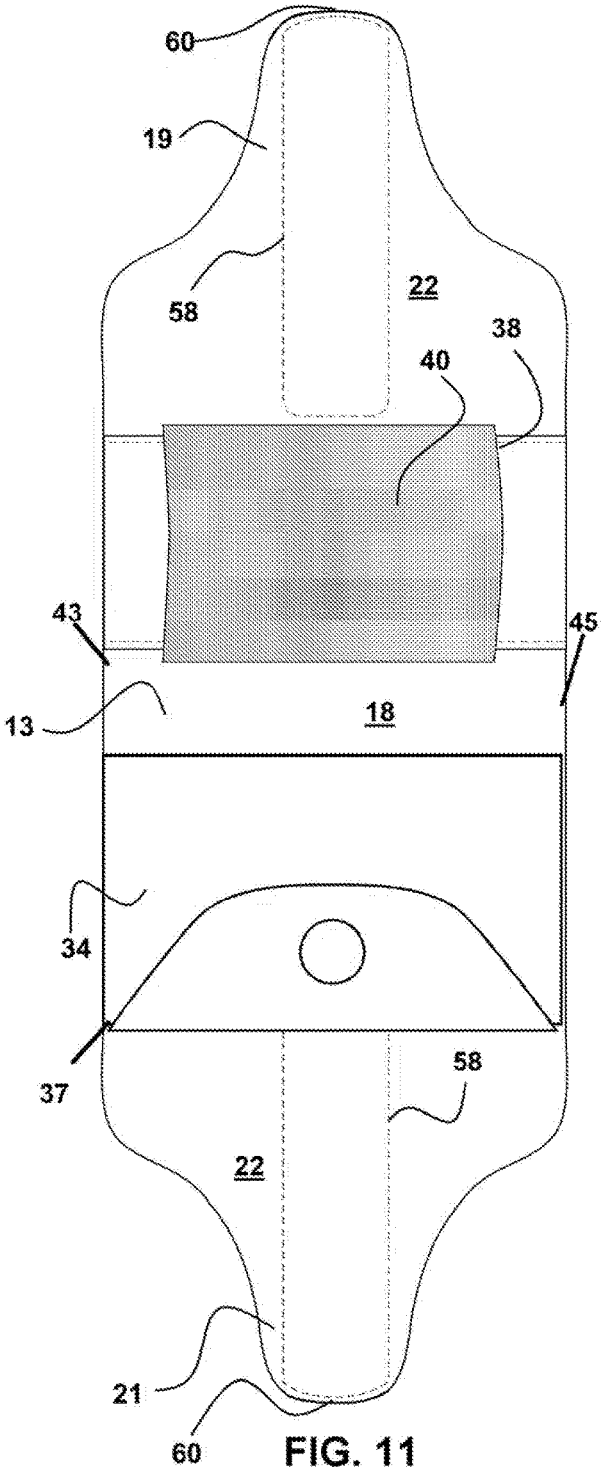
FIG. 11 shows an overhead view of the first side of the body of the device as in FIG. 7, showing a first pocket with a closure and second pocket for the fluid container positioned thereon.

In FIG. 11 is shown an overhead view of the first side 19 of the body 12 of the device 10 in an opposite view from FIG. 10. Shown in FIG. 11 is the first pocket 34 with a closure and second pocket 38 formed of an elastic sidewall 40 engaged to the first side 19, for compressively holding a fluid container positioned therein.

In FIG. 12 is shown the device of FIG. 7, in a stand configuration, or forming a stand which is held upright by the extending second pocket 38 holding the fluid container 39 therein. In this stand configuration, the body 12 is dismounted from the object such as the eyeglass case 14. This view also shows the overlapping curved compressive engagement of the second end 21 overlapping the first end 19 where the distal ends 60 of both the first end 19 and second end 21, are held biased by the members 56 therein, and below a high point 62 of the biased overlapped engagement. Friction between the surfaces of the first end 19 and second end 21, and the bias of the members 56 running in both ends, holds the distal ends down below the high pont 62, and holds both in the frictional engagement.

In FIG. 13, the body 12 is in the stand configuration held upright by the second pocket and its contents. In this view, one end such as the first end 19 of the body has been pulled from the biased overlapping engagement with the second end 12 by user or other force sufficient to overcome the curved memory of the member 56 running axially within the cavity 58 of the first end 19. As noted, particularly preferred is the inclusion of a member 56 which has a central portion 61 of the elongated member 56 running axially, which arches in a curve 59 to a position above the two side edges 63. Once the member 56 with the curve 59 portion is straightened, to force of the side edges 63 is sufficient along with the resistance of the material forming the body 12, to hold the member 56 and body 12 surrounding it on either the first end 19 or second end 21, in a substantially planar positioning. The member 56 without the curve 59 which is substantially planar as in FIG. 14, will also maintain a planar configuration if the material forming the body 12 surrounding it is sufficiently stiff to resist the bias of the member 56 once forced to the planar configuration. However, in experimentation, the member 56, having the curve 59 running along the axis of the member 56 in-between the two sides 63, has shown to better achieve the biased overlapping engagement of the two ends, and maintain it, and such would be most preferred.

The member 56 in a planar configuration is shown in FIG. 14, which depicts a sectional view through either of the two ends of the body 12 of the device 10 of FIG. 7-13. As shown the elongated member 56 is held within a formed cavity in-between the first side 18 and second side 20 of the body 12.

In FIG. 15 is shown the preferred configuration of the elongated member 56 as having a curve 59 or arched configuration along substantially its entire length. As noted this curved member 56 has shown to better maintain the curved overlapped biased engagement of the two ends.

Engagement of the device 10 around an object such as an eyeglass case is shown in FIG. 16. To form the curved overlapping biased engagement shown in FIGS. 7-9 and 12 and 17, the body 12 is urged by the user to the curved overlapping engagement of both of the two ends, by curving both ends so their member 56 biases them to a curve, and then rotating a first end around the eyeglass case 14 followed by a second end which is urged to overlap both the eyeglass case 14 and the end already curved there around. As noted, the members 56 having a memory and biasing to a curved configuration, will hold both ends in a curved configuration.

As shown in FIG. 17, the curved overlapping compressive engagement of the two ends 19 and 21, with each other is adjustable by continuing to slide them in the curved engagement until the second side 20 of the body 12 contacts the exterior of the eyeglass case 14. This forms a compressive frictional engagement of the second side 20 of the body 12 with the exterior of the eyeglass case 12 whereupon the body 14 will not easily dismount. Removal of the device 10 would be accomplished by the user urging the two ends in directions opposite to that shown in FIG. 16, or urging the first end 19 to the substantially planar configuration of FIG. 13, which releases the compressive frictional engagement of the second side 20 from the exterior of the eyeglass case 14.

While all of the fundamental characteristics and features of the contact lens transport and storage system herein have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that upon reading this disclosure and becoming aware of the disclosed novel and useful device disclosed, that various substitutions, modifications, and variations may occur to and be made by those skilled in the art without departing from the spirit or scope of the invention. Consequently, all such modifications and variations and substitutions, as would occur to those skilled in the art are considered included within the scope of the invention as defined by the following claims.

What is claimed is:

1. A contact lens travel apparatus comprising:

a body having a first side surface opposite a second side surface, said body having a first side edge which is opposite a second side edge, said first side edge and said second side edge of said body, extending between a first end and a second end of said body;

a first pocket positioned upon said body, said first pocket having a first pocket opening providing access thereto, said first pocket adapted to hold a contact lens case therein;

a second pocket positioned upon said body, said second pocket having a second pocket opening, said second pocket adapted for holding a fluid container therein;

a first elongated member engaged with a central portion of said body and extending along a first axis of said first elongated member at or adjacent said first end of said body, toward a second end of said first elongated member;

a second elongated member engaged with said central portion of said body and extending along a second axis of said second elongated member at or adjacent said second end of said body, toward a second end of said first elongated member;

said first elongated member and said second elongated member each positionable between an elongated configuration and a curled configuration;

said first elongated member in said elongated configuration maintaining said first end of said body substantially planar;

said first elongated member in said curled configuration imparting a biasing force maintaining said first end of said body in a first curve;

said second elongated member in said elongated configuration maintaining said second end of said body substantially planar;

said second elongated member in said curled configuration imparting a biasing force maintaining said second end of said body in a second curve;

said first and second elongated members in a respective said curled configuration holding said body in a removable engagement with said first end of said body in a biased contact with said second end of said body;

a first flap portion extending from said central portion of said first end of said body in-between said first side edge and said second side edge;

a second flap portion extending from said central portion of said second end of said body in-between said first side edge and said second side edge;

said first elongated member having said first end thereof at or adjacent said first end of said body in said first flap portion;

said second elongated member having said second end thereof at or adjacent said second end of said body in said second flap portion;

said removable engagement maintaining said body in a circular configuration defining a opening surrounded by one of said first side surface or said second side surface of said body;

said removable engagement being adjustable to adjust a distance of said overlap to thereby adjust said size of said opening; and said opening adapted in a size to form a contact of said first side surface or said second side surface of said body, against an exterior circumference of an eyeglass case.

2. A contact lens travel apparatus comprising:

a body having a first side surface opposite a second side surface, said body having a first side edge which is opposite a second side edge, said first side edge and said second side edge of said body, extending between a first end and a second end of said body;

a first pocket positioned upon said body, said first pocket having a first pocket opening providing access thereto, said first pocket adapted to hold a contact lens case therein;

a second pocket positioned upon said body, said second pocket having a second pocket opening, said second pocket adapted for holding a fluid container therein;

a first elongated member engaged with a central portion of said body and extending along a first axis of said first elongated member at or adjacent said first end of said body, toward a second end of said first elongated member;

a second elongated member engaged with said central portion of said body and extending along a second axis of said second elongated member at or adjacent said second end of said body, toward a second end of said first elongated member;

said first elongated member and said second elongated member each positionable between an elongated configuration and a curled configuration;

said first elongated member in said elongated configuration maintaining said first end of said body substantially planar;

said first elongated member in said curled configuration imparting a biasing force maintaining said first end of said body in a first curve;

said second elongated member in said elongated configuration maintaining said second end of said body substantially planar;

said second elongated member in said curled configuration imparting a biasing force maintaining said second end of said body in a second curve;

said first and second elongated members in a respective said curled configuration holding said body in a removable engagement with said first end of said body in a biased contact with said second end of said body;

said removable engagement maintaining said body in a circular configuration defining a opening surrounded by one of said first side surface or said second side surface of said body;

said removable engagement being adjustable to adjust a distance of said overlap to thereby adjust said size of said opening; and said opening adapted in a size to form a contact of said first side surface or said second side surface of said body, against an exterior circumference of an eyeglass case;

said first elongated member positioned within a first cavity within said body in-between said first side surface and said second side surface thereof; and said second elongated member positioned within a second cavity within said body in-between said first side surface and said second side surface thereof.

3. The contact lens travel apparatus of claim 1 additionally comprising:

said first elongated member positioned within a first cavity within said body in-between said first side surface and said second side surface thereof; and said second elongated member positioned within a second cavity within said body in-between said first side surface and said second side surface thereof.

4. The contact lens travel apparatus of claim 1 additionally comprising:

said second pocket sized for holding said fluid container therein with a cap covering a dispensing end of said fluid container projecting from said second pocket opening;

said second pocket opening positioned at or adjacent one of said first side edge or said second side edge of said body; and wherein, fluid is dispensable from said fluid container held within said second pocket by a compression of a sidewall of said second pocket, without disengaging said eyeglass case from said opening.

5. The contact lens travel apparatus of claim 2 additionally comprising:

said second pocket sized for holding said fluid container therein with a cap covering a dispensing end of said fluid container projecting from said second pocket opening;

said second pocket opening positioned at or adjacent one of said first side edge or said second side edge of said body; and wherein, fluid is dispensable from said fluid container held within said second pocket by a compression of a sidewall of said second pocket, without disengaging said eyeglass case from said opening.

6. The contact lens travel apparatus of claim 3 additionally comprising:

said second pocket sized for holding said fluid container therein with a cap covering a dispensing end of said fluid container projecting from said second pocket opening;

said second pocket opening positioned at or adjacent one of said first side edge or said second side edge of said body; and wherein, fluid is dispensable from said fluid container held within said second pocket by a compression of a sidewall of said second pocket, without disengaging said eyeglass case from said opening.

7. The contact lens travel apparatus of claim 1 additionally comprising:

a mirror positioned upon said second surface of said body;

said body positioned to said circular configuration positioning said mirror elevated above a support surface supporting said body; and an angle of said mirror adapted for adjustment relative to a position of a face of a user, by a repositioning of said second surface of said body upon said support surface.

8. The contact lens travel apparatus of claim 2 additionally comprising:

a mirror positioned upon said second surface of said body;

said body positioned to said circular configuration positioning said mirror elevated above a support surface supporting said body; and an angle of said mirror adapted for adjustment relative to a position of a face of a user, by a repositioning of said second surface of said body upon said support surface.

9. The contact lens travel apparatus of claim 3 additionally comprising:

a mirror positioned upon said second surface of said body;

said body positioned to said circular configuration positioning said mirror elevated above a support surface supporting said body; and an angle of said mirror adapted for adjustment relative to a position of a face of a user, by a repositioning of said second surface of said body upon said support surface.

10. The contact lens travel apparatus of claim 4 additionally comprising:

a mirror positioned upon said second surface of said body;

said body positioned to said circular configuration positioning said mirror elevated above a support surface supporting said body; and an angle of said mirror adapted for adjustment relative to a position of a face of a user, by a repositioning of said second surface of said body upon said support surface.

11. The contact lens travel apparatus of claim 5 additionally comprising:

a mirror positioned upon said second surface of said body;

said body positioned to said circular configuration positioning said mirror elevated above a support surface supporting said body; and an angle of said mirror adapted for adjustment relative to a position of a face of a user, by a repositioning of said second surface of said body upon said support surface.

12. The contact lens travel apparatus of claim 6 additionally comprising:

a mirror positioned upon said second surface of said body;

said body positioned to said circular configuration positioning said mirror elevated above a support surface supporting said body; and an angle of said mirror adapted for adjustment relative to a position of a face of a user, by a repositioning of said second surface of said body upon said support surface.

13. The contact lens travel apparatus of claim 1 additionally comprising:

at least one of two side surfaces of said second pocket formed of elastic material; and said second pocket opening being stretchable and thereby adapted for insertion and removal of said fluid container from said second pocket with said body in said circular configuration.

14. The contact lens travel apparatus of claim 2 additionally comprising:

at least one of two side surfaces of said second pocket formed of elastic material; and said second pocket opening being stretchable and thereby adapted for insertion and removal of said fluid container from said second pocket with said body in said circular configuration.

* * * * *